United States Patent [19]

Pence

[11] Patent Number: 4,793,156

[45] Date of Patent: Dec. 27, 1988

[54] GEM SETTING WITH CHANNEL-SHAPED SUPPORT

[75] Inventor: Ernest W. Pence, Ambler, Pa.

[73] Assignee: Keystone Findings, Inc., Harleysville, Pa.

[21] Appl. No.: 10,408

[22] Filed: Feb. 3, 1987

[51] Int. Cl.[4] ..... A44C 17/02

[52] U.S. Cl. ..... 63/26; 63/15

[58] Field of Search ..... 63/15, 15.7, 26, 29 R, 63/30; 24/113 R, 113 MD; D11/35, 91, 92

[56] References Cited

U.S. PATENT DOCUMENTS

| | | | |
|---|---|---|---|
| 157,332 | 12/1874 | Hubbard . | |
| D. 195,690 | 7/1963 | Gibeault . | |
| D. 196,135 | 8/1963 | Hazelquist | D11/92 |
| 532,587 | 1/1895 | Schill . | |
| 664,725 | 12/1900 | Costigan | 63/15 X |
| 1,035,310 | 8/1912 | Brevetti . | |
| 1,114,370 | 10/1914 | Ladd . | |
| 1,326,977 | 1/1920 | Schwartzman . | |
| 1,453,708 | 5/1923 | Gaschke | 63/15 |
| 1,585,516 | 5/1926 | Steller . | |
| 1,941,782 | 1/1934 | Bager . | |
| 2,035,244 | 3/1936 | Pejchar . | |
| 2,184,749 | 12/1939 | Manne et al. . | |
| 2,763,140 | 9/1956 | Lutrario | 63/15.7 |
| 3,643,467 | 2/1972 | Postel | D11/35 X |

FOREIGN PATENT DOCUMENTS

| | | | |
|---|---|---|---|
| 564287 | 10/1958 | Canada | 63/15 |

*Primary Examiner*—Kenneth J. Corner
*Assistant Examiner*—James R. Brittain
*Attorney, Agent, or Firm*—Steele, Gould & Fried

[57] ABSTRACT

A method and apparatus for forming a setting for an article such as a gemstone, and the setting formed, use a sheet metal support member defining channel-like ends that bear against ends of the article. The method includes folding a length of sheet material along an axis to form a support member defining a channel, compressing a central part of the channel while leaving the ends open thereby forming holding channels connected by to form a central web, and affixing a prong member to the web portion of the channel by soldering. The web portion of the channel is notched for receiving the prong member and bent transverse to its fold to bring the channel-shaped opposite ends of the support member into opposition. Support members can be produced to cover a range of gem sizes by trimming and notching the support member of one range size as required to fit a certain gem size in the range. The notching step is aligned such that the support member when bent defines a rectilinear notch for the prong member. The finished article has one or more prong members nested together with the web portion of the support member.

5 Claims, 2 Drawing Sheets

GEM SETTING WITH CHANNEL-SHAPED SUPPORT

BACKGROUND OF THE INVENTION

1. Field of the Invention

This invention relates to the field of article supports, and in particular to a gem setting having at least one support leg of V-shaped cross-section, particularly adapted for bearing against points of marquis or pear shaped gem stones.

2. Prior Art

Gem settings normally comprise a number of metal prongs or legs radiating from a base, ends of the prongs to be bent over and hold captive a stone, without unduly concealing the stone's surface. A conventional method for forming settings for jewels and the like involves stamping out a plurality of interfittable prong members from sheet metal. Each stamped unit has two spaced prongs and the units are assembled by means of complementary notches and then soldered. The setting as so formed can be assembled into jewelry as required, for example attached to the shank of a ring, typically by soldering the attached prong members to a complementary gap in a ring shank. Settings formed from these assembled prong-pair units are typically provided to jewelers who notch the prong members adjacent their distal ends, force a faceted gemstome or the like into the notches and bend the ends of the prongs over the jewel to hold it in place in the setting.

Prong-pair members to be assembled and soldered are typically stamped from metal sheet, and when stamped have a substantially-rectangular or square cross-section along their legs. The prong-pair members each roughly form a U-shape in elevation view, being nestable and attachable to one another at the base of the U. Such systems are quite effective and popular for stones which are cut to round or radially symmetrical polygonal shapes. For heart, triangle, pear-shaped and particularly marquis stones, however, the usual prong system has drawbacks. In connection with an elongated shape such as a marquis, the prongs placed along the less-curving sides (i.e., the longer sides of the stone) may exert sufficient inward pressure against the stone, but due to obvious leverage problems, do not exert a great deal of force along the major axis of the pear or marguis-shaped stone (i.e., restricting movements of the stone end to end).

If one attempts to apply the usual type of paired-prong setting to a marquis stone, of the type having prong members of rectangular cross section, a pair of prongs must be placed at or near the pointed ends to restrict relative movement on the major axis. This detracts from the printed-end appearance of the stone. The structure also requires a relatively long prong for the ends such that it is difficult to provide the required strength of the setting that will keep the stone from loosening or being lost. According to U.S. Pat. No. Des. 195,690, a cast setting can be provided in which a portion of thinner metal encloses around the pointed ends of the marquis stone, and the setting has a pointed-end appearance. Recently, it has been attempted to form a similar structure by providing V-shaped thin sheet extensions for stubs of a short stamped prong-pair member, these thin sheet V's being aligned to enclose the pointed ends of the marquis stone and soldered to the stubs.

Soldered-on V-shaped additions to a prong-type setting are difficult to produce and have been found to lack the necessary strength. It is difficult to hold the V-shaped members in position when soldering the thin sheets to the stubs and when soldering the engaged prongs to one another. Accordingly, the cost and complexity of manufacture of settings of this type have been high, and the result is not always acceptable.

According to the present invention, a setting is provided in which V-shaped extensions adapted to enclose the ends of a marquis stone are provided in a certain type of prong formed from a continuous piece of sheet metal entirely forming at least one prong. Intermediate opposite ends forming V-shaped receptacles for the pointed ends of a marquis type stone or the like, the setting has a strong central portion of folded-over metal that is similar in size and strength to the engageable portion of a die struck prong. By folding tightly only the central portion of the sheet material, notching the center to receive one or more die struck prong members and bending the support member to bring the V-shaped ends into position to oppose one another, the thin sheet metal formed prong is substantially stronger than soldered settings, more easily manufactured, and quite effective for mounting and protecting stones. The invention is equally applicable to pear-shaped, heart, triangle and marquis stones by varying the number of V-shaped ends, the shape of the channel formed in the thin sheet and the number of supporting stamped prong-pair members used in addition to the sheet metal support member.

SUMMARY OF THE INVENTION

It is an object of the invention to provide a gem setting that is both strong, and inexpensive to manufacture in a precise manner.

It is also an object of the invention to provide a support member for gems that are not radially symmetrical, particularly, marquis and pear-shaped gems, by a process that uses an integral metal part for each prong member.

It is a further object of the invention to produce a prong member for settings having a channel-shaped cross-section adapted to the contour of the gemstone to be mounted.

It is another object of the invention to provide a more attractive setting that uses less metal relative to its strength.

It is yet another object of the invention to reduce and simplify the manufacturing steps and apparatus required to form settings for large and complex-shaped gems.

These an other objects are accomplished by a method and apparatus for forming a setting, and the setting thereby formed. The process includes folding a length of sheet material along an axis to form a support member defining a channel, compressing a central part of the channel of the support member while leaving the ends of the support member in their original channel form, thus forming a central web between channel-like receptacles, and affixing at least one prong member to the web portion. Preferably, the web portion of the support member is notched for receiving the prong member and bent transverse to its fold to bring the channel-shaped opposite ends of the support member into opposition. The method can include providing support members in several lengths, each according to a range of gem sizes, and trimming the ends of the support members within each range size as required to fit a certain gem size in the range. The notching and trimming steps are such that the support member is cut at particular complementary angles to result in a rectilinear notch and aligned channel ends after being bent. The finished article has one or more prong members nested together with the web portion of the channel member formed from sheet material.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein:

FIG. 18 is a perspective view of an assembled setting for a marquis stone or the like.

DETAILED DESCRIPTION OF THE PREFERRED EMBODIMENTS

The drawings illustrate a progression of manufacturing steps according to the invention as well as the changing shape of the stock material proceeding through the steps, to manufacture a setting for jewels and the like. The invention produces settings with sheet metal supporting members having a channel-shaped, especially V-shaped cross section at their portions bearing against ends of the jewels and a tight web of folded-over metal adapted to engage planar dye-struck prong members that engage the jewels along their sides. Settings are typically made of 10, 14 or 18 karat gold, 14 karat gold being preferred. A bar of this gold material is first compressed, for example rolled in a roller press, to the thickness required. The thickness typically ranges between 0.020 and 0.028 inches (0.5–0.7 mm). Of course a setting for a larger stone normally requires a thicker setting material and vice-versa.

Gem settings according to the invention are not limited in size. For reference purposes, the invention is discussed in connection with gemstones of up to five karats, using the ranges discussed herein. For larger stones the dimensions are increased accordingly. The range of sizes of stones is preferably subdivided, for example into six subranges. The support member to be used for a stove within a range is formed for the range size and this support member is trimmed as required for any karat size within the range. The ranges need not be equal, i.e., ranges in popular sizes can be closer to one another, etc.

Rolling or otherwise working the stock to reach a required thickness tends to harden the metal. Therefore, it is appropriate to first roll the stock preliminarily to near the required thickness, for example, 0.060 inches (1.5 mm), then anneal the stock prior to rolling in one or more further steps to a desired thickness. Without annealing the work-hardened metal, some cracking of the stock may occur. In any event, one starts by stamping blanks from sheet stock.

Figure 1:
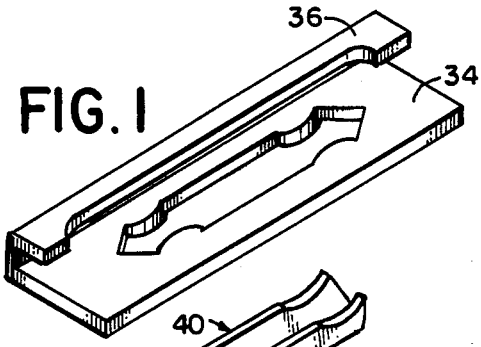
FIG. 1 is a perspective view of a die for stamping out a sheet metal support member according to the invention.
Figure 2:
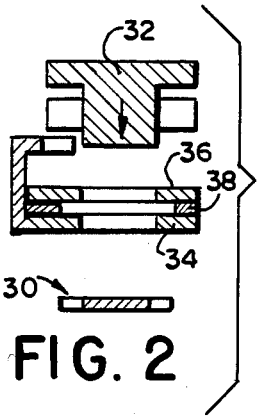
FIG. 2 is a section view of a punch/die operation taken along lines 2—2 in FIG. 1, illustrating stamping out the support member from flat stock.
Figure 3:
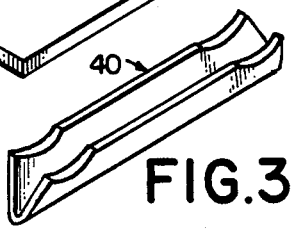
FIG. 3 is a perspective view showing a V-shaped folded support member.

FIGS. 1 and 2 illustrate a punch and die arrangement for stamping out blanks from sheet material to form the channel-shaped support member for the setting of the invention. Die 34 is provided with an opening for receiving a complementarily shaped punch 32, to force a shaped blank 30 from stock material 38, for example, 14 karat gold stock of 0.022 inches (0.56 mm) typical thickness. This stamping process as well as other stamping and forming steps herein can be accomplished using a kick press, i.e., a press manually operable by foot pressure on a pedal. The blank has a substantially rectilinear central portion and pointed winged ends which will engage against the pointed ends of the gem. The blank is folded into a channel shape, the cross-section of the channel being chosen to fit the ends of a gemstone. For example, a V-shaped channel fits the pointed ends of a marquis diamond, etc. It is also possible to configure the support member with a channel cross section other than V-shaped, for example defining a rounded U for receiving an oval or the like. Similarly, the channel can be made U-shaped on one end and V-shaped on the other.

Figure 4:
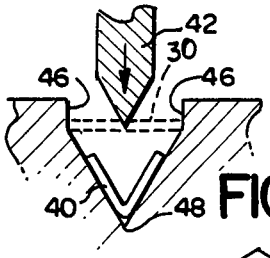
FIG. 4 is a section view illustrating a means for forming the V-shaped support member from the flat stamped blank.

FIG. 4 illustrates a means for forming a V-shape by folding the blank along its longitudinal axis. Folded blank 40 is formed by supporting a flat blank between the vertical walls 46 of die 44 and pressing the blank into the V-shaped receptacle using a pressing punch 42. It is possible to force the metal clear to the bottom of the V-shaped receptacle, however, it is presently preferred to allow a radius 48 in the folded blank 40. As folded, the ends of the blank are shaped to complement the ends of a gemstone such as a marquis diamond or the like.

Figure 5:
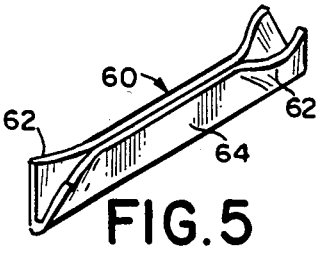
FIG. 5 is a perspective view showing a support member having a compressed central portion forming a web.
Figure 6:
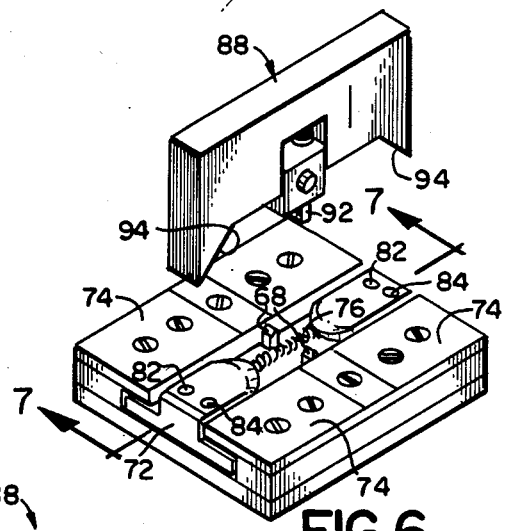
FIG. 6 is a perspective view of a forming apparatus operable to compress a channel-shaped article as in FIG. 3 into the formed article of FIG. 5.
Figure 7:
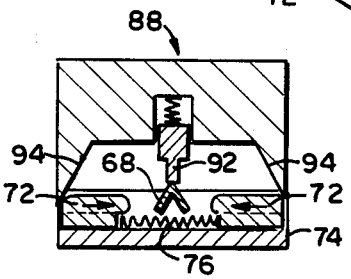
FIG. 7 is a section view taken along lines 7—7 in FIG. 6.
Figure 9:
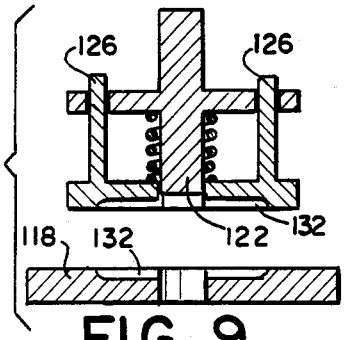
FIG. 9 is a section view taken along lines 9—9 in FIG. 8.

FIGS. 5–7 illustrate a method and apparatus for crimping or compressing a middle web portion 64 of the blank. Formed blank 60 is made by compressing only the central portion of the folded blank 40, for example using the forming mechanism shown in FIGS. 6 and 7. A folded blank 40 with its channel opening downwardly is supported on upwardly-oriented holding points 68. Forming pressers 72 are movable inwardly to compress the middle portion 64, leaving the flared ends 62 of the formed blank 60 in place. Forming apparatus 60 has an upper punch member 88 that is movable downwardly over the holding means 68 and pressers 72. Inclined surfaces 94 on presser 88 translate the downward motion of punch 88 into an inward displacement of the pressers 72 to accomplish forming. Pressers 72 are mounted in slides defined by plates 74, disposed at a space above a base, and are resiliently biased outwardly by means of spring 76. Spring 76 is disposed in a slot in the base and bears against the pressers 72 by means of pins 82, extending downwardly into the slot. Pins 84 also extend downwardly to hold pressers 72 at their outermost position against the resilient bias of spring 76.

Figure 8:
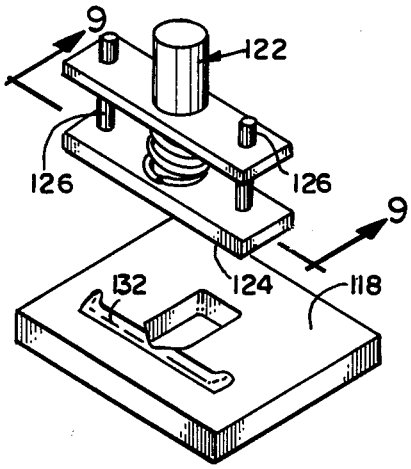
FIG. 8 is a perspective view of a cutter operable to notch an intermediate portion of the formed support member shown in FIG. 5.

Movable upper member 88 has a relatively-movable spring biased holding device 92 mounted thereon. Resilient member 92 secures the blank in place on holders 68 during the inward transit of resiliently biased pressers 72. This action is illustrated cross sectionally in FIG. 7, where element 92 is shown bearing resiliently against folded blank 40 while the pressers 72 move inwardly due to action of inclined surfaces 94. The result of this forming is illustrated in FIG. 5, and may be characterized as a thicker intermediate connecting web 64 due to folding the halves of the blank into contact with one another, leaving thinner V-shaped end portions 62 in place. The connecting ends 62 are now in the proper channel shape (in this case for a marquis), but still must be bent upwardly to bring the opposite ends into position facing one another, to receive the stone. While it would be possible to simply bend the blank as it is, this would place a strain on the web portion 64 due to its width in the direction of bending, and could cause the web to wrinkle or crack. According to the invention, web portion 64 is notched prior to bending, thereby relieving some of the strain for bending and also providing a means for forming a rectilinear notch that will engage with one or more additional prong members to be attached to the support member in the completed device. FIG. 8 illustrates cutting of the notch.

Figure 10:
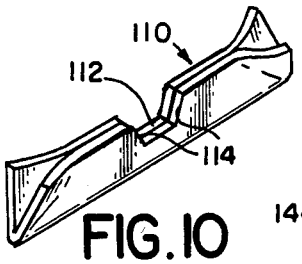
FIG. 10 is a perspective view of a notched and formed support member.

In FIG. 8, corresponding notching die 118 and punch 122 are brought together over a formed blank 60 as shown in FIG. 5, to form the notch formed blank 110, shown in FIG. 10. The formed blank is placed in a receptacle 132, holding the blank in horizontal position for cutting. A portion of the blank extends over the hole in the die and is cut away by passage of the punch 122. Punch 122 has a resiliently-mounted stripper plate 124, with guide pins 126, that holds the blank in place as the punch passes. Corresponding receptacles 132 on stripper 124 and die 118 reflect the shape of formed blank 60 and hold the blank in place. Stripper plate 124 is resiliently biased by means of spring 128, the spring allowing a travel of the punch while both stripper 124 and die 118 engage the blank.

The notch in formed blank 110 is cut with sloping sides 114 and a flat bottom 112, as shown in FIG. 10. The alignment of the sloped sides is such that when the ends of the blank are trimmed and bent inwardly around the notch until sides 114 are parallel to one another, the opposed ends of the blank are at proper spacing and position to hold a predetermined size of stone. The sides 114 of this rectilinear notch tightly engage the prong member(s) placed therein. One prong member can be placed perpendicular to the axis of support 110, or a pair of prong members can be crossed therein at 60°, 45° or at another angle relative to the axis, as required for a particular stone.

Figure 11:
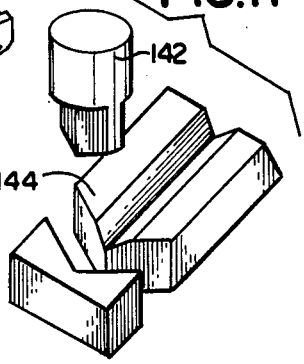
FIG. 11 is a perspective view illustrating a cutter and die for trimming an end of the support member.
Figure 12:
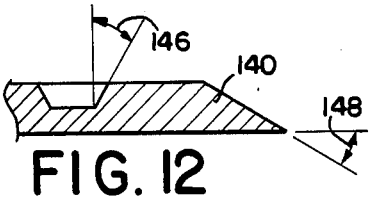
FIG. 12 is a partial elevation view of the support member of FIG. 10, showing the relationship of the notch and end angles.

The untrimmed support members formed to the point shown in FIG. 5 are used for any stone size within a certain range, and their ends are trimmed and notches cut to accommodate the particular required stone size within the range. A trimming mechanism is shown in FIG. 11. Particular trimming angles are illustrated in FIG. 12. Inasmuch as the finished device is to be bent with respect to FIG. 10, the end is trimmed at an angle 148, by means of a cutter 1 and holder 144. Angle 148 is normally such that the end of the channel is at most horizontal in the finished part. The end of the channel can also slope downwardly from the point in the finished part. Holder 144 positions the blank at the required angle with respect to the stroke of cutter 1, thereby providing a finished cut end at a maximum angle 148 perpendicular to the angle 146 of the notch (for horizontal ends). Accordingly, trimmed blank 140 is adapted such that when bent to bring the sides of the notch into parallel, the ends of the trimmed blank 140 will be aligned.

Figure 13:
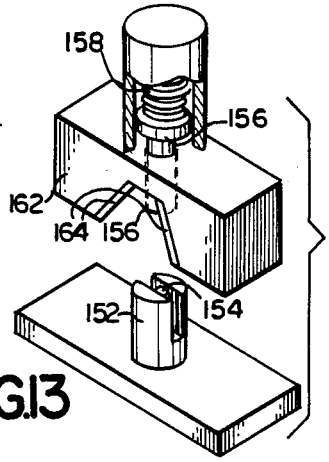
FIG. 13 is a perspective view showing a bending apparatus for operating on the support member of FIG. 10.
Figure 14:
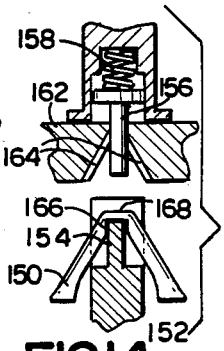
FIG. 14 is a section view taken along lines 14—14 in FIG. 13.

FIGS. 13 and 14 illustrate bending support member 40 into position. The support member is placed on a post 152 having a pin 154 in a notch at the end thereof. A bending former 162 having surfaces 164 aligned to the finished product and a resiliently-mounted pin 156, are movable downwardly on the support member. A notched support member as shown in FIG. 10, preferably already trimmed as in FIG. 12, is laid across the end of pin 154. Resilient pin 156 contacts a straight blank 110 before it is ultimately bent, holding the blank such that the bottom 112 of the notch rests securely on the flat top of pin 154. Pin 156 is resiliently mounted using spring 158, however, pin 156 is adapted to bottom out, rather than to be pushed back without limitation. Accordingly, as the forming part 162 moves downwardly, the blank is held then bent, and finally as pin 156 bottoms, a flat bottom portion 168 is formed at the end of the formed, bent blank 150.

Figure 15:
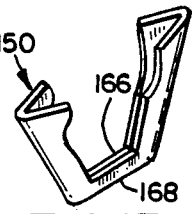
FIG. 15 is a perspective view of a formed and bent support member, operable as a point-engaging prong member in a setting.
Figure 16:
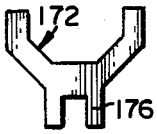
FIGS. 16 and 17 illustrate stamped planar prong members, the prong member in FIG. 17 also being notched along an angle relative to its plane.
Figure 17:
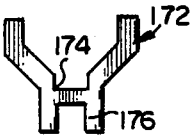

The finished support member 150 is shown in FIG. 15. It will be noted that a square notch 166 is now defined between the opposed channels, and between flat 168 and the bottom of notch 166, a certain substantially-rectiliner length of material is deined at the bottom of the notch. This length of material is adapted to receive and engage one or more prong members whose distal ends will engage the transverse sides of the stone to be mounted in the setting. Preferably, the prong members are stamped from sheet metal, preferably thicker than blank 30 for the support member, and notched such that they nest with one another and with support member 150 in the finished product. This provides a mechanical engagement that even apart from any soldering will remain secure. The prong members have distal ends that extend upwardly and in use will be bent over the faceted edge of a stone or the like. The central block to which the distal ends are mounted is notched from below, forming a notch 176 and, if necessary to nest tightly with other prong members and support members, also notched from above at notch 174. These prong members 172 are shown in FIGS. 16 and 17. The device of FIG. 16 is notched two thirds of the way through the bottom portion at bottom notch 176, and no notch is placed in the top. This prong fits perpendicularly to a support member notched one third, from the top. In FIG. 17, upper notch 174 in that prong extends one third of the distance and bottom notch 176 extends one third of the distance through the bottom member. Accordingly, notched prong members according to FIGS. 16 and 17 can be tightly fit to one another in a crossed configuration and will occupy the upper two thirds of the length of the base portion. The bottom one third can be occupied by the central web portion of a support member 150 as shown in FIG. 15, forming a tightly nested structure.

Figure 18:
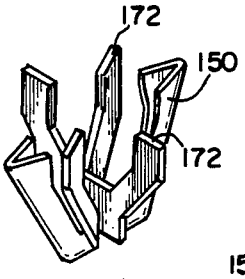
Figure 20:
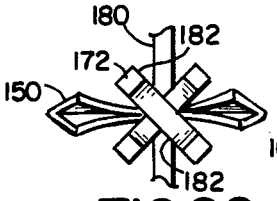
FIG. 20 is a plan view of a setting with one support member and one prong member.
Figure 19:
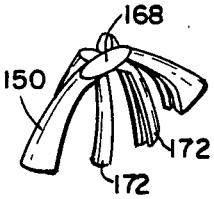
FIG. 19 is a perspective view of the assembled setting from an underside thereof.
Figure 21:
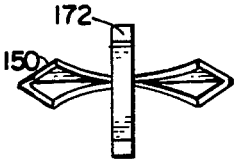
FIG. 21 is a partial plan view of a ring including two prong members and a support member carried on a ring shank.

Some alternative prong and support member constructions are shown in FIGS. 18–22. In FIGS. 18, 19 and 20, two prong members are provided and one support member receives the prong members. The prong members need not be aligned precisely at 45° to the longitudinal axis of support member 150. On the contrary, as shown in FIG. 19, it is also possible and preferable to use a somewhat-steeper angle, for example 60° such that the prong members are placed somewhat closer to one another and farther from the axis of support 150 than 45°. In FIG. 21, a single prong member 172 is mounted transverse to support 150, both the prong member 172 and support member 150 having perpendicular notches cut therethrough for receiving one another. The prong member 172 of FIG. 21 will be substantially as shown in FIG. 16, with a perpendicularly cut notch 176 corresponding to the space between the bottom of notch 166 of formed part 150 and the flattened bottom 168.

FIG. 18 shows a pair of prong members nested together with a support member 150. These prong members are preferably notched from above and below such that they engage tightly with support member 150. Moreover, as shown in FIG. 17, the notched passage of the prong members through one another and through the support member is somewhat at an angle. With the prong members, and also possibly the support member, being cut with sloping notches, their surfaces rest in direct contact. It is also possible after assembling the prong members according to the alignment of their notches, for example at 45° as shown in FIG. 18 or 20, to bend the prongs of the notches more closely to an axis perpendicular to the axis of support 150, for example at 60°. In other words, the distal ends of prong members 172 can be bent more closely toward the shank 180 of the ring as shown in FIGS. 20 or 22, to hold the mounted gem (not shown) farther inwardly from the ends.

Figure 22:
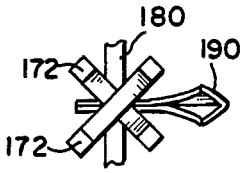
FIG. 22 is a plan view of a setting adapted for receiving a pear-shaped stone.

FIG. 22 illustrates an embodiment of the invention adapted for a pear-shaped stone or tear drop, i.e., having a pointed end opposite a bluntly rounded or faceted front. A single channel receptacle end 190 is provided on the support member, but in other respects including notching and engagement with prong members 172, the pear-shaped configuration conforms with the particulars disclosed with respect to marquis stones, etc. The embodiment of FIG. 22 also has a ring shank 180, cut to a pointed arrangement adapted to engage closely against the contours of the setting as defined the prong members 172 and support member 190. Although it is possible in such a setting to provide a wide U-shaped channel at one end of the embodiment of FIG. 22 and a narrower V-shaped channel at the opposite end for the more pointed side of the stone, such an arrangement is presently not preferred, and the rounded front of the stone is preferably left uncovered for aesthetic purposes.

Having been formed and assembled in a manner characterized by good physical engagement between the connected parts, the setting is soldered, for example by placing a lump of solder at the junction of the support part and the prong(s) members, and heating the device to about 1500° F. (825° C.) for 12 to 15 minutes. During this time, the individual settings being soldered can be held, for example, in simple light-weight carriers. Complex carriers and holding jigs are unnecessary. Due to their physical engagement, the parts need not be supported with any carrier at all (i.e., they could be simply set on a conveyor or the like). Nevertheless, for convenience in processing a batch of settings they are placed in a carrier for heating. The carrier can be a simple suspended horizontal shape with receiving holes for the settings. Each hole is of a diameter less than the maximum span of support member 150, whereby the settings rest in the holes. Preferably, soldering is conducted in an oxygen-free environment (for example in hydrogen gas), to retain surface brightness of the gold.

The invention having been disclosed, a number of variations will now occur to persons skilled in the art. Reference should be made to the appended claims rather than the foregoing specification as indicating the true scope of the invention.

What is claimed is:

1. A setting for mounting an article such as a gemstone, comprising:

at least one support member formed of a length of sheet material folded longitudinally to define a channel, two opposite ends of the support member defining receptacles for receiving parts of said article, sides of the support member being compressed together to form a web portion of the support member at a space from the receptacles, the support member being folded along its length to define the receptacles and the support member being bent in a direction perpendicular to a direction of folding to face said receptacles toward one another, the channel being V-shaped in cross-section at the receptacles, and the sides of the channel being folded tightly into contact at said web portion, the support member being operable to confine the article between the opposite ends of the support member; and, at least one prong member attached to the support member at said compressed web portion, the prong member having spaced distal ends for confining the article between the distal ends and the receptacle, the prong member being operable to confine the article transversely to said opposite ends of the support member.

2. The setting of claim 1, wherein the web portion has a notch for receiving the prong member, the notch having parallel sides bearing against a prong member.

3. The setting of claim 2, wherein the prong member is planar and has a complementary notch to the notch of the web portion, whereby the prong member and support member fit tightly.

4. The setting of claim 3, comprising two of said prong members, each of the prong members being notched to engage one another and the support member, the complementary notch of each said prong member being angled relative to a plane of the prong member.

5. The setting of claim 3, wherein the prong member is soldered to the support member.

* * * * *